US011879166B2

(12) United States Patent
Bürger et al.

(10) Patent No.: US 11,879,166 B2
(45) **Date of Patent: *Jan. 23, 2024**

(54) 7XXX-SERIES ALUMINIUM ALLOY PRODUCT

(71) Applicant: Aleris Rolled Products Germany GmbH, Koblenz (DE)

(72) Inventors: Achim Bürger, Höhr-Grenzhausen (DE); Philippe Meyer, Koblenz (DE); Sunil Khosla, Bramcote (GB); Sabine Maria Spangel, Koblenz (DE); Christian Gerhard Krechel, Koblenz (DE)

(73) Assignee: Novelis Koblenz GmbH, Koblenz (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/292,901

(22) PCT Filed: Nov. 5, 2019

(86) PCT No.: PCT/EP2019/080190
§ 371 (c)(1),
(2) Date: May 11, 2021

(87) PCT Pub. No.: WO2020/099174
PCT Pub. Date: May 22, 2020

(65) Prior Publication Data

US 2021/0404037 A1 Dec. 30, 2021

(30) Foreign Application Priority Data

Nov. 12, 2018 (EP) ..... 18205674

(51) Int. Cl.
*C22C 21/10* (2006.01)
*C22F 1/053* (2006.01)

(52) U.S. Cl.
CPC ..... *C22C 21/10* (2013.01); *C22F 1/053* (2013.01)

(58) Field of Classification Search
None
See application file for complete search history.

(56) References Cited

U.S. PATENT DOCUMENTS

| | | | | |
|---|---|---|---|---|
| 3,287,185 | A * | 11/1966 | Vachet | C22C 21/10 148/702 |
| 4,648,913 | A | 3/1987 | Hunt et al. | |
| 5,047,092 | A | 9/1991 | Faure | |
| 5,312,498 | A | 5/1994 | Anderson | |
| 2002/0121319 | A1* | 9/2002 | Chakrabarti | B22D 17/2209 148/417 |
| 2004/0089378 | A1 | 5/2004 | Senkov et al. | |
| 2004/0211498 | A1* | 10/2004 | Keidel | C22F 1/053 148/697 |
| 2005/0034794 | A1* | 2/2005 | Benedictus | C22C 21/10 148/552 |
| 2006/0174980 | A1* | 8/2006 | Benedictus | C22C 21/10 148/552 |
| 2006/0191609 | A1* | 8/2006 | Dangerfield | C22C 21/10 148/552 |
| 2008/0173378 | A1* | 7/2008 | Khosla | C22F 1/053 148/552 |
| 2011/0111081 | A1* | 5/2011 | Chen | C22C 21/10 425/542 |
| 2012/0090742 | A1* | 4/2012 | Smeyers | C22F 1/053 148/417 |
| 2012/0291926 | A1 | 11/2012 | Misra et al. | |
| 2014/0069557 | A1* | 3/2014 | Smeyers, Sr | C22C 21/10 148/695 |
| 2014/0125090 | A1* | 5/2014 | Braunschweig | C22F 1/053 296/193.06 |
| 2014/0209222 | A1 | 7/2014 | Shikama et al. | |
| 2017/0121795 | A1* | 5/2017 | Yan | C22F 1/053 |
| 2017/0306466 | A1* | 10/2017 | Meyer | C21D 9/63 |
| 2020/0232072 | A1* | 7/2020 | Whelchel | B64C 3/187 |

FOREIGN PATENT DOCUMENTS

| | | |
|---|---|---|
| CA | 3074942 | 4/2019 |
| CN | 101115856 | 1/2008 |
| CN | 101413079 | 4/2009 |
| CN | 101484603 | 7/2009 |
| CN | 101509091 | 8/2009 |
| CN | 103233148 B | 1/2016 |
| EP | 0030070 A1 | 6/1981 |
| EP | 0863220 | 9/1998 |

(Continued)

OTHER PUBLICATIONS

International Application No. PCT/EP2019/080190, International Search Report and Written Opinion, dated Jan. 16, 2020, 10 pages.
Canadian Application No. 3,112,047 , Office Action, dated Feb. 9, 2022, 5 pages.
Chinese Application No. 201980074393.1 , Office Action, dated Nov. 26, 2021, 15 pages.
Indian Application No. 202117013037 , "First Examination Report", dated Jan. 20, 2022, 6 pages.
Japanese Application No. 2021-523677 , Office Action, dated May 24, 2022, 16 pages.

(Continued)

*Primary Examiner* — Mary I Omori

(74) *Attorney, Agent, or Firm* — Kilpatrick Townsend & Stockton LLP

(57) ABSTRACT

The invention relates to a wrought 7xxx-series aluminium alloy product having a composition comprising, in wt. %., Zn 6.20 to 7.50, Mg 2.15 to 2.75, Cu 1.20 to 2.00, and wherein Cu+Mg<4.50, and wherein Mg<2.5+5/3(Cu-1.2), Fe up to 0.25, Si up to 0.25, and optionally one or more elements selected from the group consisting of: (Zrup to 0.3,Crup to 0.3,Mnup to 0.45,Tiup to 0.25, Scup to 0.5, Agup to 0.5), the balance being aluminium and impurities.

17 Claims, No Drawings

(56) References Cited

FOREIGN PATENT DOCUMENTS

| | | |
|---|---|---|
| EP | 3818187 | 11/2021 |
| FR | 2838135 | 10/2003 |
| JP | S5244712 | 4/1977 |
| JP | S58213851 | 12/1983 |
| JP | S6353236 | 3/1988 |
| JP | H03140433 | 6/1991 |
| JP | 2009167464 | 7/2009 |
| JP | 2011058047 | 3/2011 |
| RU | 2425902 | 8/2011 |
| RU | 2443797 | 2/2012 |
| RU | 2569275 | 11/2015 |

OTHER PUBLICATIONS

Russian Application No. 2021110822, Office Action, dated Feb. 10, 2022, 12 pages.
Chinese Application No. 201980074393.1 , "Office Action", dated Jun. 1, 2022, 13 pages.
European Application No. 19800967.2, "Intention to Grant", dated Sep. 16, 2022, 7 pages.
Fan et al., "Metallography & Heat Treatment", Metallurgical Industry Press, Jan. 31, 2017, pp. 263-264.
He et al., "Failure Analysis", National Defence Industry Press, Mar. 31, 2017, p. 149.
Korean Application No. 10-2021-7008383 , "Office Action", dated Jun. 30, 2022, 4 pages.
Russian Application No. 2021110822 , "Notice of Decision to Grant", dated Jul. 25, 2022, 18 pages.
Brazilian Application No. 112021004434-5 , "Office Action", dated Jan. 24, 2023, 5 pages.
Canadian Application No. 3,112,047 , "Notice of Allowance", dated Dec. 14, 2022, 1 page.
Japanese Application No. 2021-523677 , "Office Action", dated Dec. 13, 2022, 17 pages.
Korean Application No. 10-2021-7008383 , "Office Action", dated Jan. 31, 2023, 6 pages.
"American National Standard Alloy and Temper Designation Systems for Aluminum", Secretariat the Aluminum Association, The Aluminum Association Inc., 2009, 13 pages.
"English Translation of CN 103233148 B", Jan. 20, 2016, 42 pages.
"Heat Treating of Aluminum Alloys", ASM Handbook, vol. 4, 1991, pp. 841-879.
"International Alloy Designs and Chemical Composition Limits for Wrought Aluminium and Wrought Aluminium Alloys", The Aluminium Association, Inc, 2015, 38 pages.
"Rolling Aluminum: From the Mine Through the Mill", The Aluminum Association, Inc., 2007, 135 pages.

* cited by examiner

7XXX-SERIES ALUMINIUM ALLOY PRODUCT

FIELD OF THE INVENTION

The invention relates to a wrought Al—Zn—Mg—Cu aluminium type (or 7000- or 7xxx-series aluminium alloys as designated by the Aluminium Association). More specifically, the present invention is related to an age-hardenable, high strength, highly stress corrosion resistant aluminium alloy which is resistant to hydrogen embrittlement, and products made of that aluminium alloy. Products made from this alloy are very suitable for aerospace applications, but not limited to that. The aluminium alloy can be processed to various product forms, e.g. thin plate, thick plate, extruded or forged products.

BACKGROUND TO THE INVENTION

High strength aluminium alloys which are based on the aluminium-zinc-magnesium-copper system are used in numerous applications. Typically the property profile of these alloys needs to be tuned to the application and it is difficult to improve one property without adversely affecting other properties. For example, strength and corrosion resistance need to be balanced by applying the most suitable temper for the target application. Another property of relevance is the resistance to hydrogen embrittlement, where brittle cracking of a material can occur when a susceptible alloy is subjected to a sustained stress in the ST direction for longer periods of time in a humid atmosphere. This phenomenon, also known as environmentally assisted cracking ("EAC"), can be a challenge for component manufacturers since under certain conditions the structural integrity can be affected. Sensitivity to this form of EAC has been observed especially in high Zn containing high strength aluminium alloys. Therefore, there is a need for aluminium alloys which combine a high strength with good SCC corrosion resistance and at the same time having an increased resistance to the phenomenon of hydrogen embrittlement.

Patent document EP-0863220-A1 (Alusuisse) discloses a connection element, in particular a screw or a rivet, made from a 7XXX-series alloy of defined composition. The method of manufacturing this connection element includes casting a billet, homogenising and extruding the billet, solution annealing and quenching, cold forming and artificial ageing, and whereby a reversion annealing is carried out at a temperature of 180° C. to 260° C. for 5 sec to 120 min prior to the cold forming. No reference is made to the EAC resistance of this product.

DESCRIPTION OF THE INVENTION

As will be appreciated herein, except as otherwise indicated, aluminium alloy designations and temper designations refer to the Aluminium Association designations in Aluminium Standards and Data and the Registration Records, as published by the Aluminium Association in 2018 and are well known to the person skilled in the art. The temper designations are laid down in European standard EN515.

For any description of alloy compositions or preferred alloy compositions, all references to percentages are by weight percent unless otherwise indicated.

As used herein, the term "about" when used to describe a compositional range or amount of an alloying addition means that the actual amount of the alloying addition may vary from the nominal intended amount due to factors such as standard processing variations as understood by those skilled in the art.

The term "up to" and "up to about", as employed herein, explicitly includes, but is not limited to, the possibility of zero weight-percent of the particular alloying component to which it refers. For example, up to 0.5% Sc may include an aluminium alloy having no Sc.

It is an object of the invention to provide a wrought 7xxx-series aluminium alloy product having an improved balance of high strength, high SCC resistance and having an improved resistance to hydrogen embrittlement.

This and other objects and further advantages are met or exceeded by the present invention providing a wrought 7xxx-series aluminium alloy product, and preferably having a gauge of at least 12.7 mm (0.5 inches), and having a composition comprising, in wt. %., Zn 6.20% to 7.50%,
Mg 2.15% to 2.85%,
Cu 1.20% to 2.00%,
and with the proviso for the Cu- and Mg-content such that Cu+Mg<4.50% and Mg<2.5+5/3(Cu-1.2),
Fe up to 0.25%, preferably up to 0.15%,
Si up to 0.25%, preferably up to 0.15%,
and optionally one or more elements selected from the group consisting of:
Zr up to 0.3%,
Cr up to 0.3%,
Mn up to 0.45%,
Ti up to 0.25%, preferably up to 0.15%,
Sc up to 0.5%,
Ag up to 0.5%,
the balance being aluminium and impurities. Typically, such impurities are present each<0.05% and total<0.15%.

The wrought 7xxx-series aluminium alloy product having an improved balance of high strength, high SCC resistance and having a good hydrogen embrittlement resistance.

More in particular the wrought 7xxx-series aluminium alloy product according to this invention is aged to achieve two or more of the following properties:

- a conventional tensile yield strength (in MPa) measured in accordance with ASTM-B557-15 standard in the L-direction measured at quarter thickness of more than 470-0.12*(t-100) MPa (t being the thickness of the product in mm). In a preferred embodiment the tensile yield strength is >485-0.12(t-100) MPa, preferably >500-0.12(t-100) MPa, and more preferably >510-0.12 (t-100) MPa.
- a minimum life without failure due to stress corrosion cracking (SCC) measured in accordance with ASTM G47-98 of at least 20 days, preferably of at least 30 days, at a short transverse (ST) stress level of 170 MPa. In a preferred embodiment at a short transverse (ST) stress level of 205 MPa, and more preferably of 240 MPa.
- a minimum life without failure due to environmental assisted cracking (EAC) in a sodium chloride free humid atmosphere and measured with constant load testing configurations in accordance with ASTM G47-98 on round ST tension specimens of at least 50 days, preferred of at least 95 days, more preferred of at least 140 days, most preferred of at least 185 days, at a short transverse (ST) constant load stress level of 85% Yield Strength (YS), and with a continuous exposure to a temperature of 70° C., and at a humidity of 85% (RH).

In an embodiment the wrought aluminium alloy product has a Zn-content of maximum 7.30%, and preferably of maximum 7.10%. A preferred minimum Zn-content is 6.40%, more preferably 6.50%, more preferably 6.60%, and most preferably 6.75%.

In an embodiment the wrought aluminium alloy product has a Cu-content of maximum 1.90%, and preferably of maximum 1.80%, and more preferably of maximum 1.75%, and most preferably of maximum 1.70%. A preferred minimum Cu-content is 1.30%, and more preferably 1.35%.

In an embodiment the wrought aluminium alloy product has a Mg-content of at least 2.25%, and preferably of at least 2.30%, more preferably of at least 2.35%, and most preferably of at least 2.45%. In an embodiment the wrought aluminium alloy product has a Mg-content of maximum 2.75%, preferably of maximum 2.60%, and more preferably of maximum 2.55%.

In a preferred embodiment the wrought aluminium alloy product has Zn 6.40% to 7.30%, Mg 2.25% to 2.75%, and Cu 1.25% to 1.90%, and with the proviso Cu+Mg<4.45 and Mg<2.55+2(Cu-1.25).

In more preferred embodiment the wrought aluminium alloy product has Zn 6.50% to 7.20%, Mg 2.30% to 2.60%, and Cu 1.30% to 1.80%.

In more preferred embodiment the wrought aluminium alloy product has Zn 6.75% to 7.10%, Mg 2.35% to 2.55%, and Cu 1.35% to 1.75%.

In a most preferred embodiment, the wrought aluminium alloy product has Zn 6.75% to 7.10%, Mg 2.45% to 2.55%, and Cu 1.35% to 1.75%.

An overview of the preferred Zn, Cu and Mg ranges for the wrought aluminium alloy product according to the invention is given in Table 1 below.

TABLE 1

An overview of the preferred Zn, Cu and Mg ranges in the wrought 7xxx-series aluminium alloy product according to this invention.

| | Zn | Mg | Cu | Proviso |
|---|---|---|---|---|
| Broad | 6.20-7.50 | 2.15-2.85 | 1.20-2.00 | Cu + Mg < 4.50 & Mg < 2.5 + 5/3 * (Cu − 1.2) |
| Preferred | 6.40-7.30 | 2.25-2.75 | 1.25-1.90 | Cu + Mg < 4.45 & Mg < 2.55 + 2 * (Cu − 1.25) |
| More preferred | 6.50-7.20 | 2.30-2.60 | 1.30-1.80 | — |
| More preferred | 6.75-7.10 | 2.35-2.55 | 1.35-1.75 | — |
| Most preferred | 6.75-7.10 | 2.45-2.55 | 1.35-1.75 | — |

In an embodiment the wrought aluminium alloy product further comprises up to 0.3% of one or more elements selected from the group of V, Ni, Co, Nb, Mo, Ge, Er, Hf, Ce, Y, Dy, and Sr.

The iron and silicon contents should be kept significantly low, for example not exceeding about 0.15% Fe, and preferably less than 0.10% Fe, and not exceeding about 0.15% Si and preferably 0.10% Si or less. In any event, it is conceivable that still slightly higher levels of both impurities, at most about 0.25% Fe and at most about 0.25% Si may be tolerated, though on a less preferred basis herein.

The wrought aluminium alloy product comprises optionally one or more dispersoid forming elements to control the grain structure and the quench sensitivity selected from the group consisting of: Zr up to 0.3%, Cr up to 0.3%, Mn up to 0.45%, Ti up to 0.25%, Sc up to 0.5%.

A preferred maximum for the Zr level is 0.25%. A suitable range of the Zr level is about 0.03% to 0.25%, and more preferably about 0.05% to 0.18%, and most preferably about 0.05% to 0.13%. Zr is the preferred dispersoid forming alloying element in the aluminium alloy product according to this invention.

The addition of Sc is preferably not more than about 0.5% and more preferably not more than about 0.3%, and most preferably not more than about 0.25%. A preferred lower limit for the Sc addition is 0.03%, and more preferably 0.05%. In an embodiment, when combined with Zr, the sum of Sc+Zr should be less than 0.35%, preferably less than 0.30%.

Another dispersoid forming element that can be added, alone or with other dispersoid formers is Cr. Cr levels should preferably be below 0.3%, and more preferably at a maximum of about 0.25%, and most preferably at a maximum of about 0.22%. A preferred lower limit for the Cr would be about 0.04%.

In another embodiment of the aluminium alloy wrought product according to the invention it is free of Cr, in practical terms this would mean that it is considered an impurity and the Cr-content is up to 0.05%, and preferably up to 0.04%, and more preferably only up to 0.03%.

Mn can be added as a single dispersoid former or in combination with any one of the other mentioned dispersoid formers. A maximum for the Mn addition is about 0.4%. A practical range for the Mn addition is in the range of about 0.05% to 0.4%, and preferably in the range of about 0.05% to 0.3%. A preferred lower limit for the Mn addition is about 0.12%. When combined with Zr, the sum of Mn plus Zr should be less than about 0.4%, preferably less than about 0.32%, and a suitable minimum is about 0.12%.

In another embodiment of the aluminium alloy wrought product according to the invention it is free of Mn, in practical terms this would mean that it is considered an impurity and the Mn-content is up to 0.05%, and preferably up to 0.04%, and more preferably only up to 0.03%.

In another embodiment each of Cr and Mn are present only at impurity level in the aluminium alloy wrought product. Preferably the combined presence of Cr and Mn is only up to 0.05%, preferably up to 0.04%, and more preferably up to 0.02%.

Silver (Ag) in a range of up to 0.5% can be purposively added to further enhance the strength during ageing. A preferred lower limit for the purposive Ag addition would be about 0.05% and more preferably about 0.08%. A preferred upper limit would be about 0.4%.

In an embodiment the Ag is an impurity element and it can be present up to 0.05%, and preferably up to 0.03%.

In an embodiment the wrought 7xxx-series aluminium alloy product, preferably having a gauge of at least 12.7 mm (0.5 inches), has a composition consisting of, in wt. %., Zn 6.20% to 7.50%,
Mg 2.15% to 2.85%,
Cu 1.20% to 2.00%,
and with the proviso Cu+Mg<4.50 and Mg<2.5+5/3(Cu-1.2),
Fe up to 0.25%,
Si up to 0.25%,
and optionally one or more elements selected from the group consisting of:
Zr up to 0.3%,
Cr up to 0.3%,
Mn up to 0.45%,
Ti up to 0.25%,
Sc up to 0.5%,
Ag up to 0.5%, the balance being aluminium and impurities each <0.05%, total <0.15%, and with preferred narrower compositional ranges as herein described and claimed.

To provide the best balance in strength, SCC resistance and hydrogen embrittlement resistance the wrought product is preferably provided in an over-aged T7 condition. More preferably a T7 condition is selected from the group consisting of: T73, T74, T76, T77, and T79.

In a preferred embodiment the wrought product is provided in a T74 temper, more in particular a T7451 temper, or in a T76 temper, more in particular in a T7651 temper.

In a preferred embodiment the wrought product is provided in a T77 temper, more in particular a T7751 temper, or in a T79 temper, more in particular in a T7951 temper.

In a preferred embodiment the wrought product according to this invention has a nominal thickness of at least 12.7 mm (0.5 inches). In a further embodiment the thickness is at least 25.4 mm (1.0 inches). In yet a further embodiment the thickness is at least 38.1 mm (1.5 inches), and preferably at least 76.2 mm (3.0 inches). In an embodiment, the maximum thickness is 304.8 mm (12.0 inches). In a preferred embodiment the maximum thickness is 254 mm (10.0 inches) and more preferably 203.2 mm (8.0 inches).

The wrought product can be provided in various forms, in particular as a rolled product, an extruded product or as a forged product.

In a preferred embodiment the wrought product is provided as a rolled product, more in particular as a rolled plate product.

In an embodiment the wrought product is an aerospace product, more in particular an aircraft structural part, e.g. a wing spar, wing rib, wing skin, floor beam, or fuselage frame.

In a particular embodiment the wrought product is provided as a rolled product, ideally as an aircraft structural part, having a thickness in a range of 38.4 mm (1.5 inches) to 307.2 mm (12.0 inches), and with preferred narrower ranges as herein described and claimed, and is provided in a T7 condition, more preferably in a T74 or T76 condition. In this embodiment the rolled product has the properties as herein described and claimed.

In a particular embodiment the wrought product is provided as a rolled product, ideally as an aircraft structural part, having a thickness in a range of 38.1 mm (1.5 inches) to 304.8 mm (12.0 inches), and with preferred narrower ranges as herein described and claimed, and is provided in a T76 condition, more preferably a T7651 condition. In this embodiment the rolled product has the properties as herein described and claimed.

In a further aspect of the invention it relates to a method of producing the wrought 7xxx-series aluminium alloy product, preferably having a gauge of at least 12.7 mm (0.5 inches), the method comprising the steps, in that order, of:

a. casting stock of an ingot of the AA7000-series aluminium alloy according to this invention,
b. preheating and/or homogenizing the cast stock,
c. hot working the stock by one or more methods selected from the group consisting of rolling, extrusion, and forging;
d. optionally cold working the hot worked stock;
e. solution heat treating ("SHT") of the hot worked and optionally cold worked stock;
f. cooling the SHT stock, preferably by one of spray quenching or immersion quenching in water or other quenching media;
g. optionally stretching or compressing of the cooled SHT stock or otherwise cold working of the cooled SHT stock to relieve stresses, for example levelling or drawing or cold rolling of the cooled SHT stock;
h. artificial ageing of the cooled and optionally stretched or compressed or otherwise cold worked SHT stock to achieve the desired temper, preferably to a T7 condition.

The aluminium alloy can be provided as an ingot or slab or billet for fabrication into a suitable wrought product by casting techniques regular in the art for cast products, e.g. Direct-Chill (DC)-casting, Electro-Magnetic-Casting (EMC)-casting, Electro-Magnetic-Stirring (EMS)-casting. Slabs resulting from continuous casting, e.g. belt casters or roll casters, also may be used, which in particular may be advantageous when producing thinner gauge end products. Grain refiners such as those containing titanium and boron, or titanium and carbon, may also be used as is well-known in the art. The Ti-content in the aluminium alloy is up to 0.25%, and preferably up to 0.15%, and more preferably in a range of 0.01% to 0.1%. Optionally a cast ingot can be stress relieved, for example by holding it at a temperature in a range of about 350° C. to 450° C. followed by slow cooling to ambient temperature. After casting the alloy stock, an ingot is commonly scalped to remove segregation zones near the as-cast surface of the ingot.

The purpose of a homogenisation heat treatment has at least the following objectives: (i) to dissolve as much as possible coarse soluble phases formed during solidification, and (ii) to reduce concentration gradients to facilitate the dissolution step. A preheat treatment achieves also some of these objectives.

Commonly a pre-heat refers to the heating of an ingot to a set temperature and soaking at this temperature for a set time followed by the start of the hot rolling at about that temperature. Homogenisation refers to a heating, soaking and cooling cycle with one or more soaking steps, applied to a rolling ingot in which the final temperature after homogenisation is ambient temperature.

A typical pre-heat treatment for the AA7xxx-series alloy used in the method according to this invention would be a temperature of 390° C. to 450° C. with a soaking time in the range of 2 to 50 hours, more typically for 2 to 20 hours.

Firstly, the soluble eutectic phases and/or intermetallic phases such as the S-phase, T-phase, and M-phase in the alloy stock are dissolved using regular industry practice. This is typically carried out by heating the stock to a temperature of less than 500° C., typically in a range of 450° C. to 485° C., as S-phase ($Al_2MgCu$-phase) has a melting temperature of about 489° C. in AA7xxx-series alloys and the M-phase ($MgZn_2$-phase) has a melting point of about 478° C. This can be achieved by a homogenisation treatment in said temperature range and allowed to cool to the hot rolling temperature, or after homogenisation the stock is subsequently cooled and reheated before hot rolling. The homogenisation process can also be done in two or more steps if desired, and which are typically carried out in a temperature range of 430° C. to 490° C. for the AA7xxx-series alloy. For example, in a two-step process, there is a first step between 455° C. and 470° C., and a second step between 470° C. and 485° C., to optimise the dissolving process of the various phases depending on the exact alloy composition.

The soaking time at the homogenisation temperature is in the range of 1 to 50 hours, and more typically for 2 to 20 hours. The heat-up rates that can be applied are those which are regular in the art.

Following the preheat and/or homogenisation practice the stock is hot worked by one or more methods selected from the group consisting of rolling, extrusion, and forging. The method of hot rolling is preferred for the present invention.

The hot working, and hot rolling in particular, may be performed to a final gauge of preferably 12.7 mm (0.5 inches) or more.

In an embodiment the plate material is hot rolled in a first hot rolling step to an intermediate hot rolled gauge, followed by an intermediate annealing step and then hot rolled in a second hot rolling step to final hot rolled gauge.

In another embodiment the plate material is hot rolled in a first hot rolling step to an intermediate hot rolled gauge, followed by a recrystallization annealing treatment at a temperature up to the SHT temperature range and then hot rolled in a second hot rolling step to final hot rolled gauge. This will improve the isotropy of the properties and can further increase the minimum life without failure due to EAC.

Alternatively, the hot working step can be performed to provide stock at intermediate gauge. Thereafter, this stock at intermediate gauge can be cold worked, e.g. by means of rolling, to a final gauge. Depending on the amount of cold work an intermediate anneal may be used before or during the cold working operation.

A next process step is solution heat treating ("SHT") of the hot worked and optionally cold worked stock. The product should be heated to bring as much as possible all or substantially all portions of the soluble zinc, magnesium and copper into solution. The SHT is preferably carried out in the same temperature range and time range as the homogenisation treatment according to this invention as set out in this description, together with the preferred narrower ranges. However, it is believed that also shorter soaking times can still be very useful, for example in the range of about 2 to 180 minutes. The SHT is typically carried out in a batch or a continuous furnace. After SHT, it is important that the aluminium alloy be cooled with a high cooling rate to a temperature of 175° C. or lower, preferably to ambient temperature, to prevent or minimise the uncontrolled precipitation of secondary phases, e.g. $Al_2CuMg$ and $Al_2Cu$, and/or $MgZn_2$. On the other hand, cooling rates should preferably not be too high to allow for a sufficient flatness and low level of residual stresses in the product. Suitable cooling rates can be achieved with the use of water, e.g. water immersion or water jets.

The stock may be further cold worked, for example, by stretching in the range of about 0.5% to 8% of its original length to relieve residual stresses therein and to improve the flatness of the product. Preferably the stretching is in the range of about 0.5% to 6%, more preferably of about 1% to 3%. After cooling the stock is artificially aged, preferably to provide a T7 condition, more preferably a T7x51 condition.

A desired structural shape or near-net structural shape is then machined from these heat-treated plate sections, more often generally after artificial ageing, for example.

SHT, quench, optional stress relief operations and artificial ageing are also followed in the manufacture of sections made by extrusion or forged processing steps.

Having now fully described the invention, it will be apparent to one of ordinary skill in the art that many changes and modifications can be made without departing from the spirit or scope of the invention as herein described.

The invention claimed is:

1. A wrought 7xxx-series aluminium alloy product having a composition comprising, in wt. %, Zn 6.40 to 6.60,
Mg 2.25 to 2.60,
Cu 1.50 to 1.80,
and wherein Cu+Mg<4.50, and wherein Mg<2.5+5/3 (Cu−1.2),
Fe up to 0.05,
Si up to 0.05, and
optionally one or more elements selected from the group consisting of:
Zr up to 0.3,
Cr up to 0.3,
Ti up to 0.05,
Sc up to 0.05,
Ag up to 0.05,
a balance being aluminium and impurities, wherein the composition is free from Mn, wherein said wrought 7xxx-series aluminium alloy product is aged to achieve:
a minimum life without failure due to stress corrosion cracking (SCC) measured in accordance with ASTM G47-98 of at least 30 days, at a short transverse (ST) stress level of 170 MPa; and
a minimum life without failure due to environmental assisted cracking (EAC) in a sodium chloride free humid atmosphere and measured with constant load testing configurations in accordance with ASTM G47-98 on round ST tension specimens of at least 50 days at a short transverse (ST) constant load stress level of 85% Yield Strength (YS), and with a continuous exposure to a temperature of 70° C., and at a humidity of 85% (RH).

2. The wrought 7xxx-series aluminium alloy product according to claim 1, wherein the Mg-content is at least 2.30 wt. %.

3. The wrought 7xxx-series aluminium alloy product according to claim 1, wherein the Zn-content is at least 6.50 wt. %.

4. The wrought 7xxx-series aluminium alloy product according to claim 1, wherein
in wt. %, Cu+Mg<4.45, and wherein, in wt. %, Mg<2.55+2(Cu−1.25).

5. The wrought 7xxx-series aluminium alloy product according to claim 1, further comprising up to 0.3 wt. % of one or more of V, Ni, Co, Nb, Mo, Ge, Er, Hf, Ce, Y, Dy, Sr.

6. The wrought 7xxx-series aluminium alloy product according to claim 1, wherein said wrought 7xxx-series aluminium alloy product has a Zr-content in a range of 0.03 wt. % to 0.25 wt. %.

7. The wrought 7xxx-series aluminium alloy product according to claim 1, wherein said wrought 7xxx-series aluminium alloy product has a Cr-content in a range of 0.04 wt. % to 0.3 wt. %.

8. The wrought 7xxx-series aluminium alloy product according to claim 1, wherein said wrought 7xxx-series aluminium alloy product has a Cr-content of up to 0.05 wt. %.

9. The wrought 7xxx-series aluminium alloy product according to claim 1, wherein said wrought 7xxx-series aluminium alloy product has a thickness of at least 12.7 mm.

10. The wrought 7xxx-series aluminium alloy product according to claim 1, wherein said wrought 7xxx-series aluminium alloy product is an aerospace product.

11. The wrought 7xxx-series aluminium alloy product according to claim 1, wherein said wrought 7xxx-series aluminium alloy product is in a T7 condition.

12. The wrought 7xxx-series aluminium alloy product according to claim 11, wherein said wrought 7xxx-series aluminium alloy product is in the T7 condition selected from the group consisting of T73, T74, T76, T77, and T79.

13. The wrought 7xxx-series aluminium alloy product according to claim 1, wherein said wrought 7xxx-series aluminium alloy product has a thickness of at least 25.4 mm.

14. The wrought 7xxx-series aluminium alloy product according to claim 1, wherein said wrought 7xxx-series aluminium alloy product is in the form of a rolled, extruded or forged product.

15. The wrought 7xxx-series aluminium alloy product according to claim 1, wherein said wrought 7xxx-series aluminium alloy product is aged to achieve:

a conventional tensile yield strength (in MPa) measured in the L-direction measured at quarter thickness of more than 470-0.12*(t-100)MPa (t being a thickness of said wrought 7xxx-series aluminium alloy product in mm).

16. The wrought 7xxx-series aluminium alloy product according to claim 1, wherein said wrought 7xxx-series aluminium alloy product is aged to achieve:

a conventional tensile yield strength (in MPa) measured in the L-direction measured at quarter thickness of more than 485-0.12*(t-100)MPa (t being a thickness of said wrought 7xxx-series aluminium alloy product in mm);

a minimum life without failure due to stress corrosion cracking (SCC) measured in accordance with ASTM G47-98 of at least 30 days, at a short transverse (ST) stress level of 205 MPa; and the minimum life without failure due to environmental assisted cracking (EAC) in the sodium chloride free humid atmosphere and measured with constant load testing configurations in accordance with ASTM G47-98 on round ST tension specimens of at least 140 days at the short transverse (ST) constant load stress level of 85% Yield Strength (YS), and with the continuous exposure to the temperature of 70° C., and at the humidity of 85% (RH).

17. The wrought 7xxx-series aluminium alloy product according to claim 1, wherein said wrought 7xxx-series aluminium alloy product is an aircraft structural part.

* * * * *